United States Patent [19]

Cassidy et al.

[11] 4,171,519

[45] Oct. 16, 1979

[54] CIRCUIT BREAKER WITH PARALLEL SHORTING ELEMENT

[75] Inventors: Robert E. Cassidy, Seabrook, N.H.; Frank M. Latassa, Magnolia, Mass.

[73] Assignee: GTE Sylvania Incorporated, Stamford, Conn.

[21] Appl. No.: 909,893

[22] Filed: May 26, 1978

[51] Int. Cl.[2] ..... H01H 61/00

[52] U.S. Cl. ..... 337/25; 337/27

[58] Field of Search ..... 337/3, 4, 15, 16, 17, 337/22, 23, 24, 25, 27, 98, 99

[56] References Cited

U.S. PATENT DOCUMENTS 4,052,687 10/1977 Kimball et al. ..... 337/25

FOREIGN PATENT DOCUMENTS 675262 7/1952 United Kingdom ..... 337/22

*Primary Examiner*—George Harris

*Attorney, Agent, or Firm*—James Theodosopoulos

[57] ABSTRACT

A circuit breaker has a thermally sensitive bimetal connected across two lead-in wires in a glass envelope. An electrically conductive bypass element is in parallel with the bimetal and shorts it out. The bypass element can be removed from the circuit by melting it by means of a short duration pulse of high electric current. The bimetal contains means to prevent its ends from welding together should an arc occur when the bypass element is melted.

3 Claims, 1 Drawing Figure

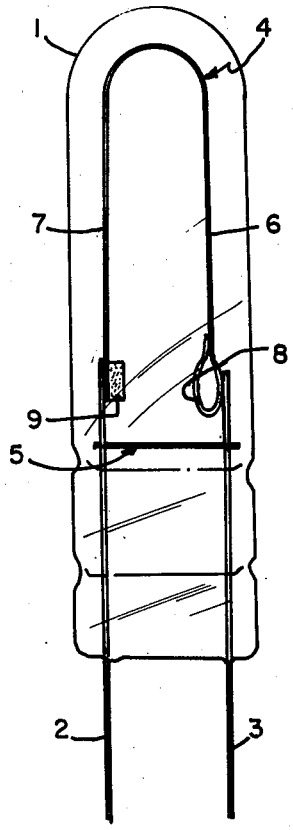
1
4
7
6
8
9
5
2
3

CIRCUIT BREAKER WITH PARALLEL SHORTING ELEMENT

THE INVENTION

This invention is concerned with circuit breakers for use with rapid start fluorescent lamps to shut off heater current to the lamp electrode after lamp ignition. Such circuit breakers and lamps are shown in U.S. Pats. No. 4,052,687, Ser. No. 673,822 filed 4/5/76, now U.S. Pat. No. 4,097,779 and 673,823 filed 4/5/76, now U.S. Pat. No. 4,114,968 the disclosures of which are incorporated herein by reference.

The circuit breaker shown in U.S. Pat. No. 4,052,687 comprises a U shaped bimetallic element shorted out by a molybdenum fuse wire. During lamp processing, the circuit breaker is opened by the heat of processing. When this occurs, the two legs of the U can be in physical contact or almost in physical contact. When an electrical pulse is delivered to the circuit breaker to melt the fuse wire, an arc sometimes occurs after the fuse is melted, which welds the two legs of the bimetallic element together, thereby rendering the circuit breaker inoperative. It is the purpose of this invention to overcome this problem.

The single FIGURE in the drawing is an expanded elevational view of a circuit breaker showing two embodiments that can be used in the invention.

As shown in the drawing, a circuit breaker in accordance with this invention comprises a sealed glass envelope 1 having lead-in wires 2 and 3 extending therethrough. In one example, glass envelope 1 was 150 mils diameter by ⅝ inch long and lead-in wires 2 and 3 were made of 20 mil dumet wire.

Fastened to the inner end of lead-in wire 2 was a U-shaped bimetal 4 which made contact with the inner end of lead-in wire 3 at room temperature. At elevated temperatures, for example, 160° C., bimetal 4 deflects away from lean-in wire 3, thereby breaking electrical contact therewith. Contact is reestablished when the breaker cools below about 150° C.

Internally connected across lead-in wires 2 and 3, in parallel electrically with bimetal 4, was an electrically conductive bypass element 5. In this example, bypass element 5 was a short piece of refractory metal wire, specifically 3 mil molybdenum wire, welded to lead-in wires 2 and 3. As long as bypass elementf 5 was intact, electric current would flow through the circuit breaker, even if bimetal 4 was open.

After the circuit breaker had been installed, for example, in a fluorescent lamp, and after bypass element 5 permitted filament breakdown current through the circuit breaker under lamp processing conditions that maintained bimetal 4 open, bypass element 5 was removed from the circuit by a high current, short duration pulse from a capacitor, for example, which melted the molybdenum wire. It is at this time that an arc can occur between the ends of bimetal 4, especially if the end of leg 6 of bimetal 4 has deflected sufficiently to be in contact or almost in contact with the end of leg 7 thereof.

One of the means used in this invention to prevent welding of the two ends of bimetal 4 together should an arc occur is to eliminate the edge or corner at the free end of the bimetal. This edge or corner, shown in U.S. Pat. No. 4,052,687, tends to attract an arc when it is proximate the other end of the bimetal. The edge or corner is eliminated by bending the end of leg 6 back on itself, as shown at 8 in the drawing. Thus when bimetal 4 is deflected, it is curved portion 8 that is the part of leg 6 that is most proximate to the end of leg 7. Thus, even if an arc should occur, it is unlikely that it would weld smooth curved portion 8 to leg 7.

Another means of preventing such welding together is to provide a suitable insulator 9 at the end of leg 7 at the point where physical contact would be made between legs 6 and 7 when bimetal 4 is completely deflected. Insulator 9 could be a thin ceramic or mica flake adhesively bonded to leg 7, or it could be a coating of a suitable insulating material, for example, silicone or epoxy.

We claim:

1. A circuit breaker for shutting off heater current in a rapid start fluorescent lamp comrising: a sealed glass envelope having two lead-in wires extending therethrough; a U shaped bimetal within said envelope mounted on one of said lead-in wires and making electrical connection to the other lead-in wire at room temperature but separated therefrom at a predetermined elevated temperature; an electrically conductive bypass element, within said envelope across said lead-in wires in parallel with said bimetal, of the type that can be melted by a short duration pulse of high electric current; and means on the bimetal to prevent it from welding itself together because of an arc occurring upon melting of the bypass.

2. The circuit breaker of claim 1 wherein said means comprises an insulative material disposed on the bimetal between the ends thereof.

3. The circuit breaker of claim 1 wherein the end of one leg of the bimetal is curved back on itself thereby presenting a smooth surface for contact with the other leg of the bimetal when the bimetal is deflected open.

* * * * *